US009867249B2

(12) United States Patent
Melanson et al.

(10) Patent No.: US 9,867,249 B2
(45) Date of Patent: Jan. 9, 2018

(54) LOW-COST LOW-POWER LIGHTING SYSTEM AND LAMP ASSEMBLY

(71) Applicant: PHILIPS LIGHTING HOLDING B.V., Eindhoven (NL)

(72) Inventors: John L. Melanson, Austin, TX (US); Eric J. King, Dripping Springs, TX (US)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 15/375,287

(22) Filed: Dec. 12, 2016

(65) Prior Publication Data

US 2017/0094739 A1 Mar. 30, 2017

Related U.S. Application Data

(62) Division of application No. 14/166,211, filed on Jan. 28, 2014, now Pat. No. 9,521,711.

(51) Int. Cl.
*H05B 37/00* (2006.01)
*H05B 33/08* (2006.01)

(52) U.S. Cl.
CPC ..... *H05B 33/0845* (2013.01); *H05B 33/0809* (2013.01)

(58) Field of Classification Search
CPC ..... H05B 33/0815; H05B 33/0818; H05B 41/2828; H05B 41/3927; H05B 41/34; H05B 33/0803; H05B 39/09; H05B 41/28; H05B 33/0809
See application file for complete search history.

(56) References Cited

U.S. PATENT DOCUMENTS

| | | | | |
|---|---|---|---|---|
| 2009/0184666 | A1 | 7/2009 | Myers | H05B 33/0815 315/297 |
| 2011/0074310 | A1* | 3/2011 | Nakada | H05B 41/2886 315/291 |
| 2011/0109245 | A1 | 5/2011 | Lin et al. | 315/294 |
| 2011/0115400 | A1 | 5/2011 | Harrison et al. | |
| 2011/0199017 | A1* | 8/2011 | Dilger | H05B 33/0815 315/291 |
| 2011/0285289 | A1 | 11/2011 | Tremblay et al. | 315/35 |

(Continued)

FOREIGN PATENT DOCUMENTS

EP 2360991 A2 8/2011

OTHER PUBLICATIONS

International Search Report and Written Opinion, International Application No. PCT/US2015/012611, dated Aug. 25, 2015, 15 pages.

*Primary Examiner* — Minh D A

(57) ABSTRACT

In accordance with embodiments of the present disclosure, a method and apparatus includes an input having a first input terminal and a second input terminal for receiving an input waveform. In one example, the apparatus includes a capacitor having a first capacitor terminal and a second capacitor terminal, wherein the first capacitor terminal is coupled to the first input terminal, and at least one light-emitting diode coupled in series with the capacitor between the second capacitor terminal and the second input terminal, such that the light-emitting diode generates light in conformity with at least one of an amplitude modulation and a frequency modulation of the input waveform.

12 Claims, 6 Drawing Sheets

(56) References Cited

U.S. PATENT DOCUMENTS

| | | | | |
|---|---|---|---|---|
| 2013/0113458 | A1 | 5/2013 | Riesebosch | |
| 2014/0009078 | A1 | 1/2014 | Xie et al. | |
| 2015/0048761 | A1 | 2/2015 | Lau et al. | 315/307 |

* cited by examiner

LOW-COST LOW-POWER LIGHTING SYSTEM AND LAMP ASSEMBLY

FIELD OF DISCLOSURE

The present disclosure relates in general to the field of electronics, and more specifically to a low-power lighting system and methods related thereto which may provide a lower-cost solution compared to traditional approaches for ensuring compatibility between one or more low-power lamps and the power infrastructure to which they are coupled.

BACKGROUND

Many electronic systems include circuits, such as switching power converters or transformers that interface with a dimmer. The interfacing circuits deliver power to a load in accordance with the dimming level set by the dimmer. For example, in a lighting system, dimmers provide an input signal to a lighting system. The input signal represents a dimming level that causes the lighting system to adjust power delivered to a lamp, and, thus, depending on the dimming level, increase or decrease the brightness of the lamp. Many different types of dimmers exist. In general, dimmers generate an output signal in which a portion of an alternating current ("AC") input signal is removed or zeroed out. For example, some analog-based dimmers utilize a triode for alternating current ("triac") device to modulate a phase angle of each cycle of an alternating current supply voltage. This modulation of the phase angle of the supply voltage is also commonly referred to as "phase cutting" the supply voltage. Phase cutting the supply voltage reduces the average power supplied to a load, such as a lighting system, and thereby controls the energy provided to the load.

A particular type of a triac-based, phase-cutting dimmer is known as a leading-edge dimmer. A leading-edge dimmer phase cuts from the beginning of an AC cycle, such that during the phase-cut angle, the dimmer is "off" and supplies no output voltage to its load, and then turns "on" after the phase-cut angle and passes phase cut input signal to its load. To ensure proper operation, the load must provide to the leading-edge dimmer a load current sufficient to maintain an inrush current above a current necessary for opening the triac. Due to the sudden increase in voltage provided by the dimmer and the presence of capacitors in the dimmer, the current that must be provided is typically substantially higher than the steady state current necessary for triac conduction. Additionally, in steady state operation, the load must provide to the dimmer a load current to remain above another threshold known as a "hold current" needed to prevent premature disconnection of the triac.

FIG. 1 depicts a lighting system 100 that includes a triac-based leading-edge dimmer 102 and a lamp 142. FIG. 2 depicts example voltage and current graphs associated with lighting system 100. Referring to FIGS. 1 and 2, lighting system 100 receives an AC supply voltage $V_{SUPPLY}$ from voltage supply 104. The supply voltage $V_{SUPPLY}$ is, for example, a nominally 60 Hz/110 V line voltage in the United States of America or a nominally 50 Hz/220 V line voltage in Europe. Triac 106 acts as a voltage-driven switch, and a gate terminal 108 of triac 106 controls current flow between the first terminal 110 and the second terminal 112. A gate voltage $V_G$ on the gate terminal 108 above a firing threshold voltage value $V_F$ will cause triac 106 to turn ON, in turn causing a short of capacitor 121 and allowing current to flow through triac 106 and dimmer 102 to generate an output current $i_{DIM}$.

Assuming a resistive load for lamp 142, the dimmer output voltage $V_{\Phi_DIM}$, represented by waveform 206, is zero volts from the beginning of each of half cycles 202 and 204 at respective times $t_0$ and $t_2$ until the gate voltage $V_G$ reaches the firing threshold voltage value $V_F$. Dimmer output voltage $V_{\Phi_DIM}$ represents the output voltage of dimmer 102. During timer period $t_{OFF}$, the dimmer 102 chops or cuts the supply voltage $V_{SUPPLY}$ so that the dimmer output voltage $V_{\Phi_DIM}$ remains at zero volts during time period $t_{OFF}$. At time $t_1$, the gate voltage $V_G$ reaches the firing threshold value $V_F$, and triac 106 begins conducting. Once triac 106 turns ON, the dimmer voltage $V_{\Phi_DIM}$ tracks the supply voltage $V_{SUPPLY}$ during time period $t_{ON}$.

Once triac 106 turns ON, the current $i_{DIM}$ drawn from triac 106 must exceed an attach current $i_{ATT}$ in order to sustain the inrush current through triac 106 above a threshold current necessary for opening triac 106. In addition, once triac 106 turns ON, triac 106 continues to conduct current $i_{DIM}$ regardless of the value of the gate voltage $V_G$ as long as the current $i_{DIM}$ remains above a holding current value $i_{HC}$. The attach current value $i_{ATT}$ and the holding current value $i_{HC}$ is a function of the physical characteristics of the triac 106. Once the current $i_{DIM}$ drops below the holding current value $i_{HC}$, i.e. $i_{DIM}<i_{HC}$, triac 106 turns OFF (i.e., stops conducting), until the gate voltage $V_G$ again reaches the firing threshold value $V_F$. In many traditional applications, the holding current value $i_{HC}$ is generally low enough so that, ideally, the current $i_{DIM}$ drops below the holding current value $i_{HC}$ when the supply voltage $V_{SUPPLY}$ is approximately zero volts near the end of the half cycle 202 at time $t_2$.

The variable resistor 114 in series with the parallel connected resistor 116 and capacitor 118 form a timing circuit 115 to control the time $t_1$ at which the gate voltage $V_G$ reaches the firing threshold value $V_F$. Increasing the resistance of variable resistor 114 increases the time $t_{OFF}$, and decreasing the resistance of variable resistor 114 decreases the time $t_{OFF}$. The resistance value of the variable resistor 114 effectively sets a dimming value for lamp 142. Diac 119 provides current flow into the gate terminal 108 of triac 106. The dimmer 102 also includes an inductor choke 120 to smooth the dimmer output voltage $V_{\Phi_DIM}$. As known in the art, an inductor choke is a passive two-terminal electronic component (e.g., an inductor) which is designed specifically for blocking higher-frequency alternating current (AC) in an electrical circuit, while allowing lower frequency or direct current to pass. Triac-based dimmer 102 also includes a capacitor 121 connected across triac 106 and inductor choke 120 to reduce electro-magnetic interference.

Ideally, modulating the phase angle of the dimmer output voltage $V_{\Phi_DIM}$ effectively turns the lamp 142 OFF during time period $t_{OFF}$ and ON during time period $t_{ON}$ for each half cycle of the supply voltage $V_{SUPPLY}$. Thus, ideally, the dimmer 102 effectively controls the average energy supplied to lamp 142 in accordance with the dimmer output voltage $V_{\Phi_DIM}$.

The triac-based dimmer 102 adequately functions in many circumstances, such as when lamp 142 consumes a relatively high amount of power, such as an incandescent light bulb. However, in circumstances in which dimmer 102 is loaded with a lower-power load (e.g., a light-emitting diode or LED lamp), such load may draw a small amount of current $i_{DIM}$, and it is possible that the current $i_{DIM}$ may fail to reach the attach current $i_{ATT}$ and also possible that current $i_{DIM}$ may prematurely drop below the holding current value $i_{HC}$ before the supply voltage $V_{SUPPLY}$ reaches approximately zero volts. If the current $i_{DIM}$ fails to reach the attach current $i_{ATT}$, dimmer 102 may prematurely disconnect and may not pass the appropriate portion of input voltage $V_{SUPPLY}$ to its output. If the current $i_{DIM}$ prematurely drops below the holding current value $i_{HC}$, the dimmer 102 prematurely shuts down, and the dimmer voltage $V_{\Phi_DIM}$ will prematurely drop to zero. When the dimmer voltage $V_{\Phi_DIM}$ prematurely drops to zero, the dimmer voltage $V_{\Phi_DIM}$ does not reflect the intended dimming value as set by the resistance value of variable resistor 114. For example, when the current $i_{DIM}$ drops below the holding current value $i_{HC}$ at a time significantly earlier than time $t_2$ for the dimmer voltage $V_{\Phi_DIM}$ 206, the ON time period $t_{ON}$ prematurely ends at a time earlier than time $t_2$ instead of ending at time $t_2$, thereby decreasing the amount of energy delivered to the load. Thus, the energy delivered to the load will not match the dimming level corresponding to the dimmer voltage $V_{\Phi_DIM}$. In addition, when voltage $V_{\Phi_DIM}$ prematurely drops to zero, charge may accumulate on capacitor 118 and gate 108, causing triac 106 to again refire if gate voltage $V_G$ exceeds firing threshold value $V_F$ during the same half cycle 202 or 204, and/or causing triac 106 to fire incorrectly in subsequent half cycles due to such accumulated charge. Thus, premature disconnection of triac 106 may lead to errors in the timing circuitry of dimmer 102 and instability in its operation.

Another particular type of phase-cutting dimmer is known as a trailing-edge dimmer. A trailing-edge dimmer phase cuts from the end of an AC cycle, such that during the phase-cut angle, the dimmer is "off" and supplies no output voltage to its load, but is "on" before the phase-cut angle and in an ideal case passes a waveform proportional to its input voltage to its load.

FIG. 3 depicts a lighting system 300 that includes a trailing-edge, phase-cut dimmer 302 and a lamp 342. FIG. 4 depicts example voltage and current graphs associated with lighting system 300. Referring to FIGS. 3 and 4, lighting system 300 receives an AC supply voltage $V_{SUPPLY}$ from voltage supply 304. The supply voltage $V_{SUPPLY}$, is, for example, a nominally 60 Hz/110 V line voltage in the United States of America or a nominally 50 Hz/220 V line voltage in Europe. Trailing edge dimmer 302 phase cuts trailing edges, such as trailing edges 402 and 404, of each half cycle of supply voltage $V_{SUPPLY}$. Since each half cycle of supply voltage $V_{SUPPLY}$ is 180 degrees of the supply voltage $V_{SUPPLY}$, the trailing edge dimmer 302 phase cuts the supply voltage $V_{SUPPLY}$ at an angle greater than 0 degrees and less than 180 degrees. The phase cut, input voltage $V_{\Phi_DIM}$ to lamp 342 represents a dimming level that causes the lighting system 300 to adjust power delivered to lamp 342, and, thus, depending on the dimming level, increase or decrease the brightness of lamp 342.

Dimmer 302 includes a timer controller 310 that generates dimmer control signal DCS to control a duty cycle of switch 312. The duty cycle of switch 312 is a pulse width (e.g., times $t_1$-$t_0$) divided by a period of the dimmer control signal (e.g., times $t_3$-$t_0$) for each cycle of the dimmer control signal DCS. Timer controller 310 converts a desired dimming level into the duty cycle for switch 312. The duty cycle of the dimmer control signal DCS is decreased for lower dimming levels (i.e., higher brightness for lamp 342) and increased for higher dimming levels. During a pulse (e.g., pulse 406 and pulse 408) of the dimmer control signal DCS, switch 312 conducts (i.e., is "on"), and dimmer 302 enters a low resistance state. In the low resistance state of dimmer 302, the resistance of switch 312 is, for example, less than or equal to 10 ohms. During the low resistance state of switch 312, the phase cut, input voltage $V_{\Phi_DIM}$ tracks the input supply voltage $V_{SUPPLY}$ and dimmer 302 transfers a dimmer current $i_{DIM}$ to lamp 342.

When timer controller 310 causes the pulse 406 of dimmer control signal DCS to end, dimmer control signal DCS turns switch 312 off, which causes dimmer 302 to enter a high resistance state (i.e., turns off). In the high resistance state of dimmer 302, the resistance of switch 312 is, for example, greater than 1 kiloohm. Dimmer 302 includes a capacitor 314, which charges to the supply voltage $V_{SUPPLY}$ during each pulse of the timer control signal DCS. In both the high and low resistance states of dimmer 302, the capacitor 314 remains connected across switch 312. When switch 312 is off and dimmer 302 enters the high resistance state, the voltage $V_C$ across capacitor 314 increases (e.g., between times $t_1$ and $t_2$ and between times $t_4$ and $t_5$). The rate of increase is a function of the amount of capacitance C of capacitor 314 and the input impedance of lamp 342. If effective input resistance of lamp 342 is low enough, it permits a high enough value of the dimmer current $i_{DIM}$ to allow the phase cut, input voltage $V_{\Phi_DIM}$ to decay to a zero crossing (e.g., at times $t_2$ and $t_5$) before the next pulse of the dimmer control signal DCS.

Dimming a light source with dimmers saves energy when operating a light source and also allows a user to adjust the intensity of the light source to a desired level. However, conventional dimmers, such as triac-based leading-edge dimmers and trailing-edge dimmers, that are designed for use with resistive loads, such as incandescent light bulbs, often do not perform well when attempting to supply a raw, phase modulated signal to a reactive load such as an electronic power converter or transformer.

The lighting industry has provided numerous solutions for retrofitting low-power light to legacy power infrastructures. However, such solutions are often costly, requiring bulb assemblies with complex analog and digital circuitry to convert for conversion of an AC supply waveform to a DC waveform typically required by low-power lamps, including LED lamps. Additionally, bulb assemblies often also include complex analog and digital circuitry to ensure backwards compatibility for certain components within existing power infrastructures, including dimmers.

SUMMARY

In accordance with the teachings of the present disclosure, certain disadvantages and problems associated with ensuring compatibility of a low-power lamp with a legacy power infrastructure may be reduced or eliminated.

In accordance with embodiments of the present disclosure, an apparatus comprising a modulator having an input and an output may be configured to receive at the input an input waveform from a dimmer, wherein the input waveform is periodic at a first frequency. The modulator may also be configured to generate at the output an output waveform independent of a load coupled to the output, wherein the output waveform is periodic at a second frequency substantially greater than the first frequency, wherein at least one of the second frequency and an amplitude of the output waveform is based on a phase-cut angle of the input waveform indicative of a control setting of the dimmer.

In accordance with these and other embodiments of the present disclosure, an apparatus may include an input, a capacitor, and at least one light-emitting diode. The input may have a first input terminal and a second input terminal for receiving an input waveform. The capacitor may have a first capacitor terminal and a second capacitor terminal, wherein the first capacitor terminal is coupled to the first input terminal. The at least one light-emitting diode may be coupled in series with the capacitor between the second capacitor terminal and the second input terminal, such that the light-emitting diode generates light in conformity with a control setting of a dimmer coupled to the input.

In accordance with these and other embodiments of the present disclosure, a method may include receiving an input waveform from a dimmer, wherein the input waveform is periodic at a first frequency. The method may also include generating an output waveform independent of a load coupled to the output waveform, wherein the output waveform is periodic at a second frequency substantially greater than the first frequency, wherein at least one of the second frequency and an amplitude of the output waveform is based on a phase-cut angle of the input waveform indicative of a control setting of the dimmer.

Technical advantages of the present disclosure may be readily apparent to one of ordinary skill in the art from the figures, description and claims included herein. The objects and advantages of the embodiments will be realized and achieved at least by the elements, features, and combinations particularly pointed out in the claims.

It is to be understood that both the foregoing general description and the following detailed description are examples and explanatory and are not restrictive of the claims set forth in this disclosure.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION

Figure 5:
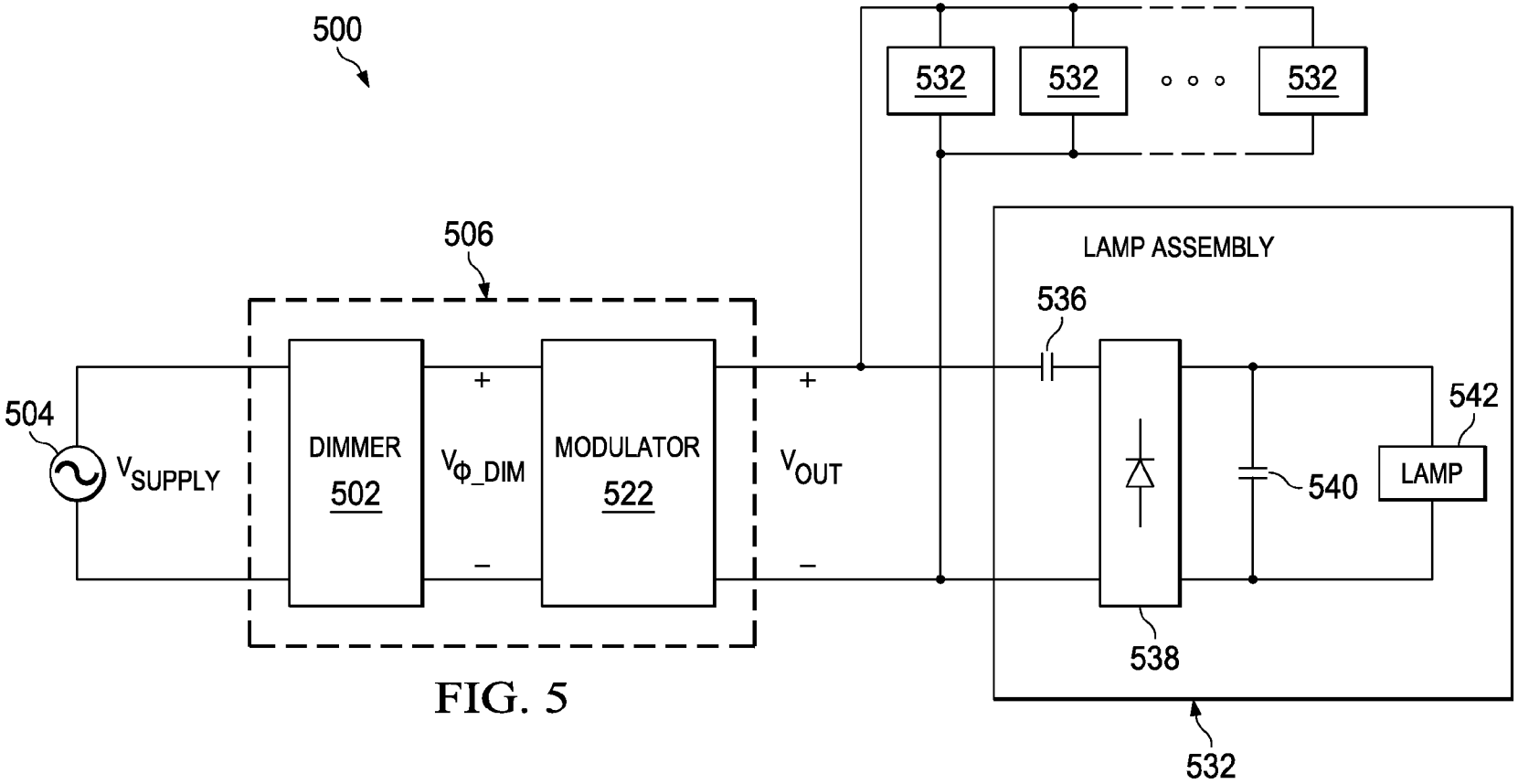
FIG. 5 illustrates an example lighting system including a modulator for providing compatibility between a low-power lamp and other elements of a lighting system, in accordance with embodiments of the present disclosure.

FIG. 5 illustrates an example lighting system 500 including a modulator 522 for providing compatibility between a low-power lamp assembly 532 and other elements of a lighting system, in accordance with embodiments of the present disclosure. As shown in FIG. 5, lighting system 500 may include a voltage supply 504, a dimmer 502, a modulator 522, and a plurality of lamp assemblies 532. Voltage supply 504 may generate a supply voltage $V_{SUPPLY}$ that is, for example, a nominally 60 Hz/110 V line voltage in the United States of America or a nominally 50 Hz/220 V line voltage in Europe.

Figure 2:
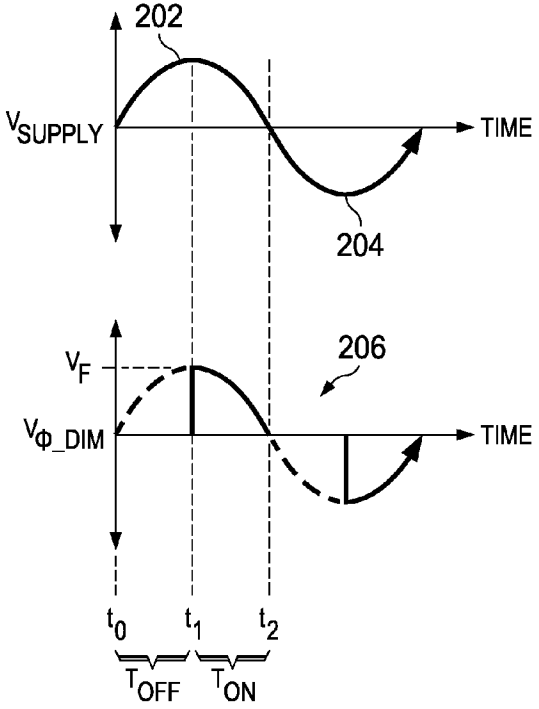
FIG. 2 (PRIOR ART)
FIG. 2 illustrates example voltage and current graphs associated with the lighting system depicted in FIG. 1, as is known in the art.
Figure 1:
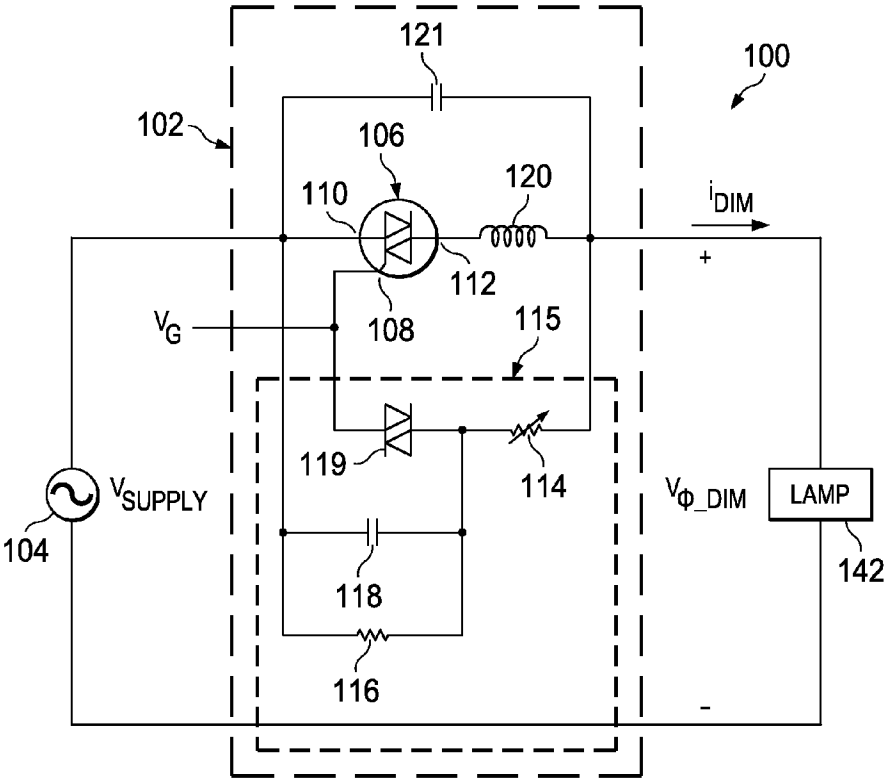
FIG. 1 (PRIOR ART)
FIG. 1 illustrates a lighting system that includes a triac-based leading-edge dimmer, as is known in the art.
Figure 3:
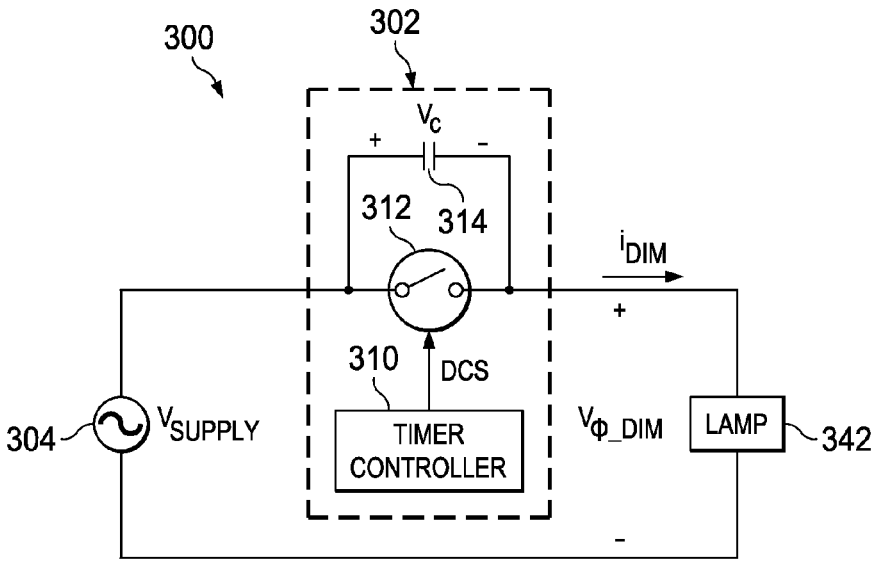
FIG. 3 (PRIOR ART)
FIG. 3 illustrates a lighting system that includes a phase-cut trailing-edge dimmer, as is known in the art.
Figure 4:
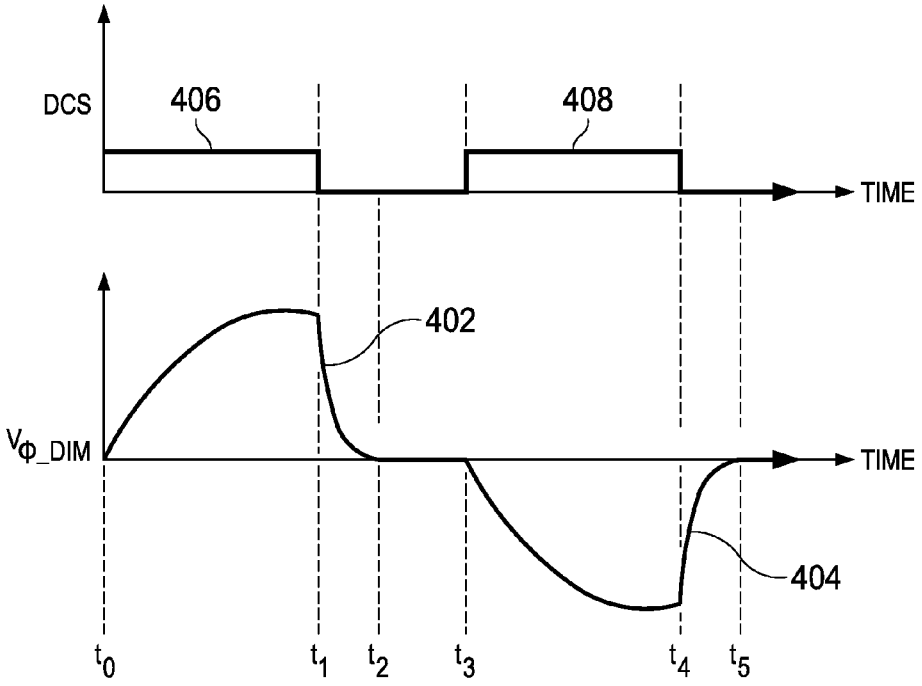
FIG. 4 (PRIOR ART)
FIG. 4 illustrates example voltage and current graphs associated with the lighting system depicted in FIG. 3, as is known in the art.

Dimmer 502 may comprise any system, device, or apparatus for generating a dimming signal $V_{\Phi_DIM}$ to other elements of lighting system 500, wherein the dimming signal $V_{\Phi_DIM}$ represents a dimming level that causes lighting system 500 to adjust power delivered to a lamp, and, thus, depending on the dimming level, increase or decrease the brightness of lamp 542. Thus, dimmer 502 may include a leading-edge dimmer similar or identical to that depicted in FIG. 1, a trailing-edge dimmer similar to that depicted in FIG. 3, or any other suitable dimmer.

Modulator 522 may comprise any system, device, or apparatus for transferring energy from an input in the form of an input waveform (e.g., $V_{\Phi_DIM}$) which is periodic at a first frequency, to an output waveform $V_{OUT}$, wherein the output waveform $V_{OUT}$ is periodic at a second frequency substantially greater than (e.g., at least an order of magnitude greater) the first frequency. In some embodiments, the second frequency may be based on a phase-cut angle of the input waveform $V_{\Phi_DIM}$ indicative of a control setting of dimmer 502 providing the input waveform $V_{\Phi_DIM}$. In these and other embodiments, the amplitude of the output waveform $V_{OUT}$ may be based on a phase-cut angle of the input waveform $V_{\Phi_DIM}$ indicative of a control setting of dimmer 502 providing the input waveform $V_{\Phi_DIM}$. As described in greater detail below, modulator 522 may be configured to drive a plurality of parallel lamp assemblies 532, each of the parallel lamp assemblies 532 comprising a capacitor (e.g., capacitor 536) in series with a light source (e.g., lamp 542) for converting electrical energy of the output waveform $V_{OUT}$ into photonic energy.

In some embodiments, a single assembly 506 (e.g., an enclosure, housing, package, etc.) may comprise both dimmer 502 and modulator 522, as shown in FIG. 5.

Figure 6A:
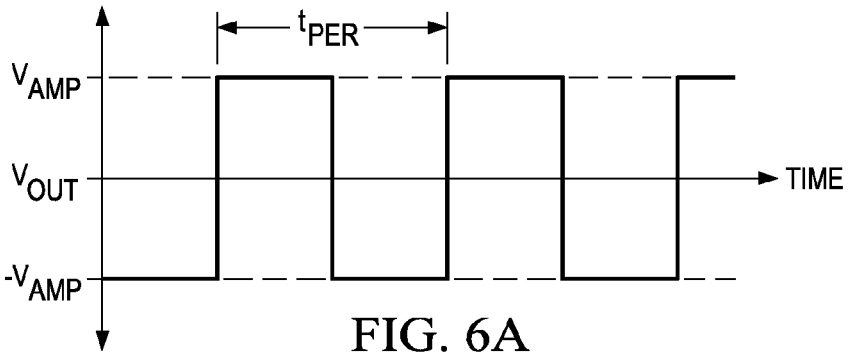
FIGS. 6A-6D illustrate example voltage graphs associated with the modulator illustrated in FIG. 5, in accordance with embodiments of the present disclosure.
Figure 6B:
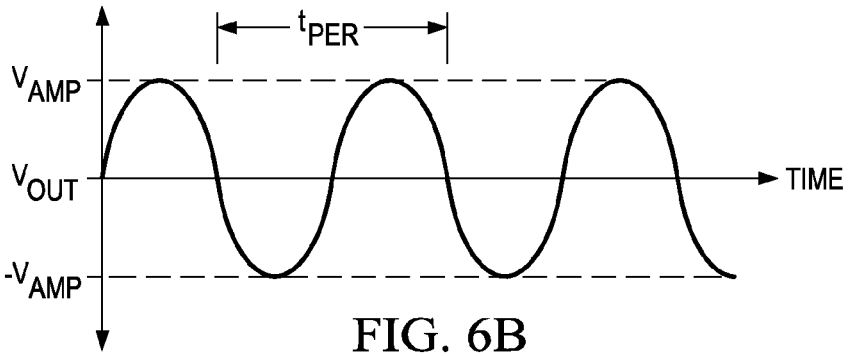
Figure 6C:
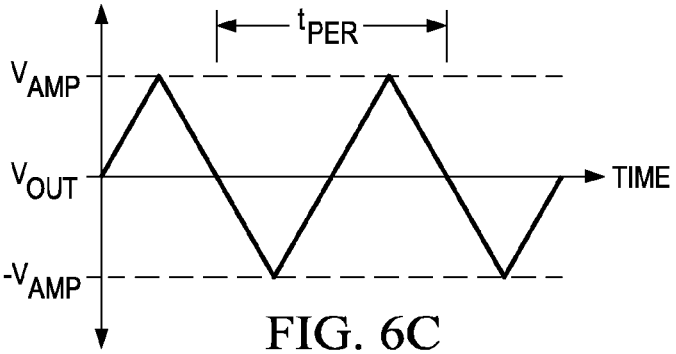
Figure 6D:
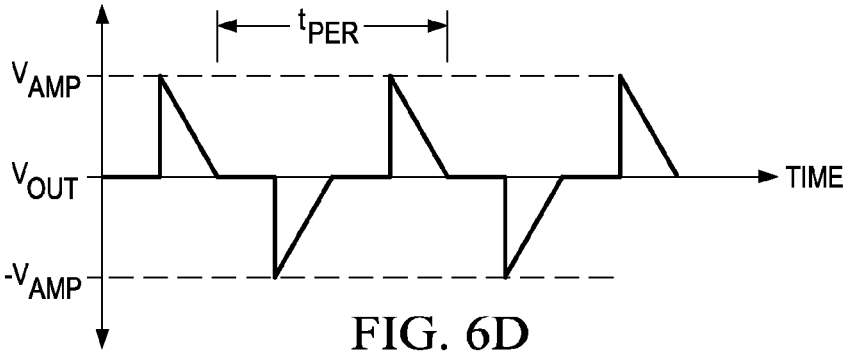

The output waveform $V_{OUT}$ generated by modulator 522 may comprise any suitable signal having an amplitude, frequency, or both which is a function of a dimmer setting (e.g., phase-cut angle). For example, as shown in FIG. 6A, output waveform $V_{OUT}$ may comprise a square wave signal with an amplitude $V_{AMP}$ dependent upon the dimming signal $V_{\Phi_DIM}$ and/or a frequency $f=1/t_{PER}$ dependent upon the dimming signal $V_{\Phi_DIM}$. As another example, as shown in FIG. 6B, output waveform $V_{OUT}$ may comprise a sinusoidal signal with an amplitude $V_{AMP}$ dependent upon the dimming signal $V_{\Phi_DIM}$ and/or a frequency $f=1/t_{PER}$ dependent upon the dimming signal $V_{\Phi_DIM}$. As a further example, as shown in FIG. 6C, output waveform $V_{OUT}$ may comprise a triangle wave signal with an amplitude $V_{AMP}$ dependent upon the dimming signal $V_{\Phi_DIM}$ and/or a frequency $f=1/t_{PER}$ dependent upon the dimming signal $V_{\Phi_DIM}$. As an additional example, as shown in FIG. 6D, output waveform $V_{OUT}$ may comprise a sawtooth signal with an amplitude $V_{AMP}$ dependent upon the dimming signal $V_{\Phi_DIM}$ and/or a frequency $f=1/t_{PER}$ dependent upon the dimming signal $V_{\Phi_DIM}$.

Figure 7A:
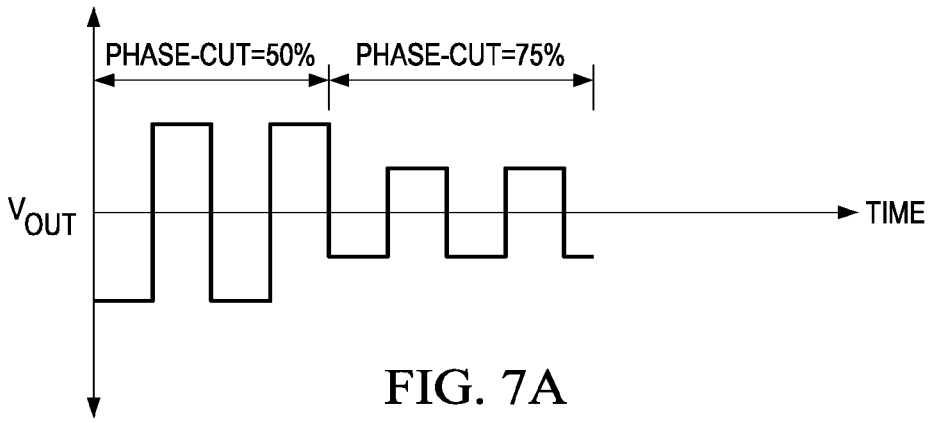
FIG. 7A illustrates an example voltage graph for a square wave output signal which is amplitude modulated based on a dimmer phase-cut angle.
Figure 7B:
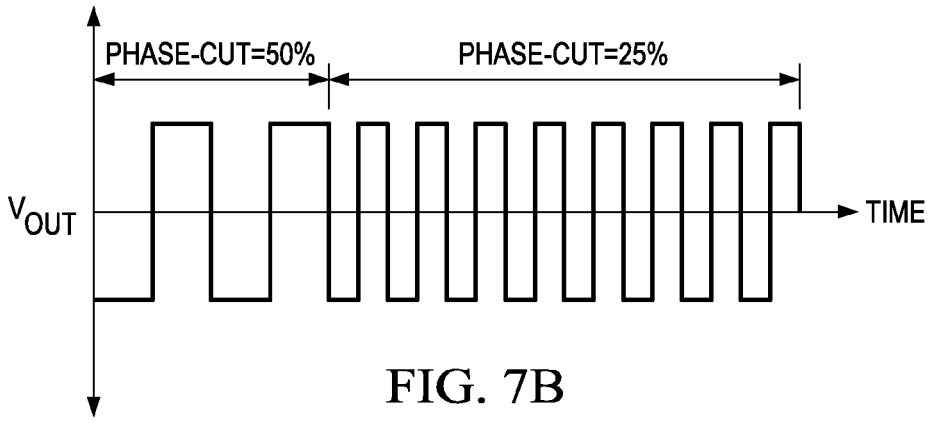
FIG. 7B illustrates an example voltage graph for a square wave output signal which is frequency modulated based on a dimmer phase-cut angle.

In operation, modulator 522 may modulate an amplitude and/or frequency of output waveform $V_{OUT}$ as shown in FIGS. 7A and 7B. FIG. 7A illustrates an example voltage graph for output waveform $V_{OUT}$ which is amplitude modulated based on a dimmer phase-cut angle of dimming signal $V_{\Phi_DIM}$. FIG. 7B illustrates an example voltage graph for output waveform $V_{OUT}$ which is frequency modulated based on a dimmer phase-cut angle of dimming signal $V_{\Phi_DIM}$. Although FIGS. 7A and 7B depict amplitude and frequency modulation of square wave waveforms, similar amplitude and frequency modulation may be applied to other types of waveforms, including sinusoidal waveforms, triangle wave signals, and sawtooth signals such as those depicted in FIGS. 6B-6D.

Figure 8A:
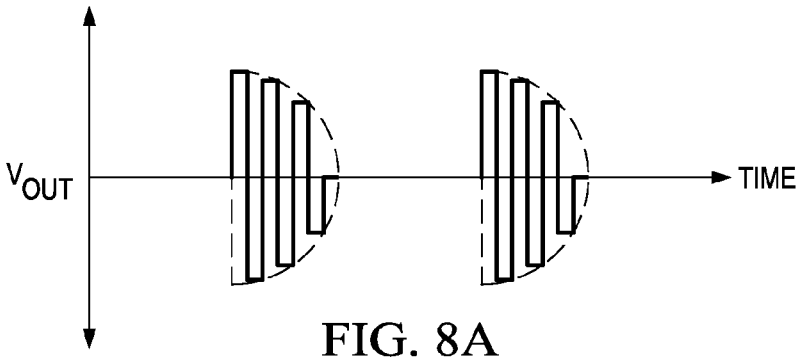
FIGS. 8A-8D illustrate additional example voltage graphs associated with the modulator illustrated in FIG. 5, in accordance with embodiments of the present disclosure.
Figure 8B:
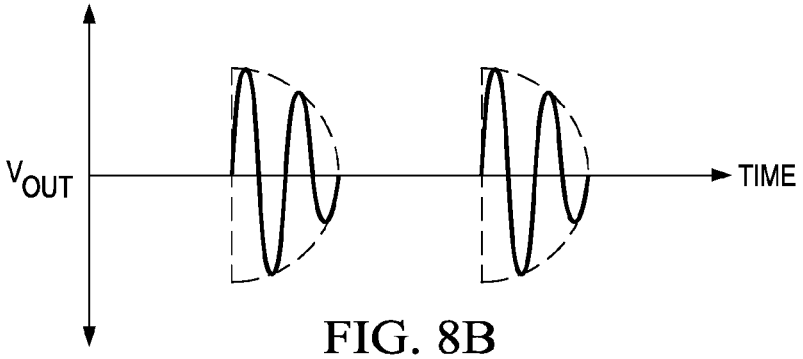
Figure 8C:
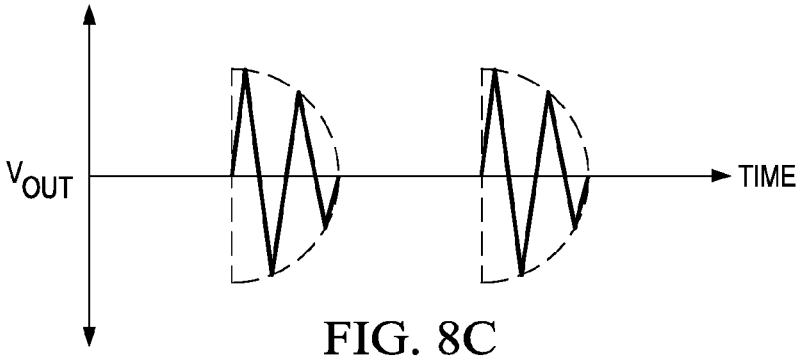
Figure 8D:
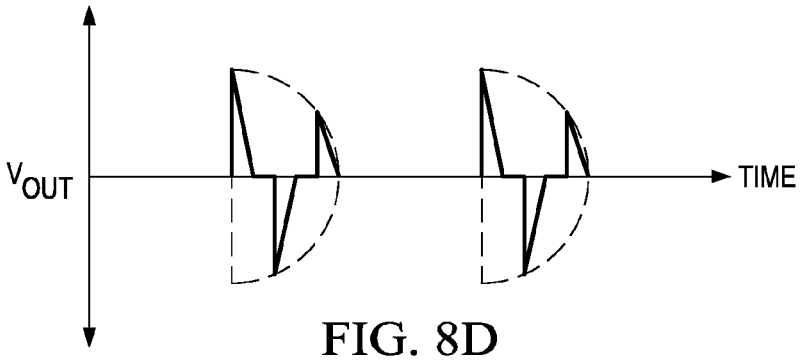

In these and other embodiments, the output waveform $V_{OUT}$ generated by modulator 522 may comprise a waveform with an envelope function proportional to the dimming signal $V_{\Phi_DIM}$. For example, as shown in FIG. 8A, output waveform $V_{OUT}$ may comprise a square wave signal with an envelope function proportional to the dimming signal $V_{\Phi_DIM}$. As another example, as shown in FIG. 8B, output waveform $V_{OUT}$ may comprise a sinusoidal signal with an envelope function proportional to the dimming signal $V_{\Phi_DIM}$. As a further example, as shown in FIG. 8C, output waveform $V_{OUT}$ may comprise a triangle wave signal with an envelope function proportional to the dimming signal $V_{\Phi_DIM}$. As an additional example, as shown in FIG. 8D, output waveform $V_{OUT}$ may comprise a sawtooth signal with an envelope function proportional to the dimming signal $V_{\Phi_DIM}$. It is noted with respect to FIGS. 8A-8D that the depicted proportionality between frequencies of example output waveforms $V_{OUT}$ and envelope functions thereof is for illustrative purposes, and in some embodiments of the present disclosure, frequencies of output waveforms $V_{OUT}$ may be at least an order of magnitude greater than the frequency of the corresponding envelope functions thereof.

Turning again to FIG. 5, a lamp assembly 532 may comprise any system, device, or apparatus for converting electrical energy (e.g., delivered by modulator 522) into photonic energy. In some embodiments, a lamp assembly 532 may comprise a multifaceted reflector form factor (e.g., an MR16 form factor). As shown in FIG. 5, a lamp assembly 532 may comprise a capacitor 536, a rectifier 538, a capacitor 540, and a lamp 542. Lamp assembly 532 may have an input having a first input terminal and a second input terminal for receiving an input waveform (e.g., modulator output waveform $V_{OUT}$). Capacitor 536 may have a first capacitor terminal and a second capacitor terminal such that the first capacitor terminal is coupled to the first input terminal of lamp assembly 532. Capacitor 536, rectifier 538, and lamp 542 may be arranged such that lamp 542 may be coupled in series with capacitor 536 between the second capacitor terminal and the second input terminal, via rectifier 538.

Rectifier 538 may comprise any system, device, or apparatus for converting an AC signal into a DC signal. Rectifier 538 may comprise a first rectifier terminal, a second rectifier terminal, a first output terminal, and a second output terminal and may be coupled to lamp 542 and capacitor 536 such that the first rectifier terminal is coupled to the second capacitor terminal of capacitor 536, the second rectifier terminal is coupled to the second input terminal, and lamp 542 is coupled between the first output terminal and the second output terminal. In some embodiments, rectifier 538 may comprise a full-bridge rectifier. In embodiments in which lamp 542 comprises one or more LEDs, rectifier 538 may comprise at least one rectifying diode coupled between the first output terminal and the second output terminal with an opposite polarity to the one or more LEDs making up lamp 542. In such embodiments, the at least one rectifying diode may comprise one or more LEDs.

Capacitor 540 may be coupled in parallel with lamp 542. In operation, capacitor 540 may store energy output by rectifier 538 which may be transferred to lamp 542.

Lamp 542 may comprise any system, device, or apparatus for converting electrical energy (e.g., delivered by rectifier 538) into photonic energy. In some embodiments, lamp 542 may comprise an LED lamp. In operation of lamp assembly 532 in lighting system 500, lamp 542 may generate light in proportion to an amplitude and/or frequency of signal $V_{OUT}$, and because the amplitude and/or frequency of signal $V_{OUT}$ may be a function of dimming signal $V_{\Phi_DIM}$, lamp 542 may generate light in conformity with a control setting of a dimmer coupled to the input.

Accordingly, by modulating the AC dimming signal $V_{\Phi_DIM}$, a dimmable lamp assembly 532 as shown in FIG. 5 and described above may be realized which translates the delivery of current typically utilized in traditional lamps (e.g., incandescent bulbs) to a delivery of charge for LEDs. In addition, whereas in traditional approaches lamp assemblies often included complex circuitry for dimmer compatibility, the methods and systems described herein provide a solution in which dimmer compatibility is essentially performed by modulator 522, which may be provided externally to a lamp assembly 532 (e.g., mounted or installed in a housing separate from lamp assemblies 532 and/or separate from any socket or connector for coupling a lamp assembly 532 to lighting system 500), such that one or more lamp assemblies 532 may receive the modulated output signal $V_{OUT}$ from modulator 522. As a result, the complex dimmer compatibility circuitry present in each lamp assembly in a traditional low-power lighting system may effectively be replaced by a single dimmer compatibility circuit, which may lead to lower cost.

As used herein, when two or more elements are referred to as "coupled" to one another, such term indicates that such two or more elements are in electronic communication whether connected indirectly or directly, with or without intervening elements.

This disclosure encompasses all changes, substitutions, variations, alterations, and modifications to the example embodiments herein that a person having ordinary skill in the art would comprehend. Similarly, where appropriate, the appended claims encompass all changes, substitutions, variations, alterations, and modifications to the example embodiments herein that a person having ordinary skill in the art would comprehend. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

All examples and conditional language recited herein are intended for pedagogical objects to aid the reader in understanding the disclosure and the concepts contributed by the inventor to furthering the art, and are construed as being without limitation to such specifically recited examples and conditions. Although embodiments of the present disclosure have been described in detail, it should be understood that various changes, substitutions, and alterations could be made hereto without departing from the spirit and scope of the disclosure.

What is claimed is:

1. An apparatus comprising:

an input having a first input terminal and a second input terminal for receiving an input waveform;

a capacitor having a first capacitor terminal and a second capacitor terminal, wherein the first capacitor terminal is coupled to the first input terminal; and at least one light-emitting diode coupled in series with the capacitor between the second capacitor terminal and the second input terminal, such that the light-emitting diode generates light in conformity with at least one of an amplitude modulation and a frequency modulation of the input waveform.

2. The apparatus of claim 1, wherein at least one of a frequency and an amplitude of the input waveform is based on a control setting of a dimmer.

3. The apparatus of claim 2, wherein the input waveform has a frequency substantially greater than a frequency of a signal received by the dimmer.

4. The apparatus of claim 1, further comprising a rectifier coupled between the capacitor and the at least one light-emitting diode, wherein the rectifier has a first rectifier terminal, a second rectifier terminal, a first output terminal, and a second output terminal, and further wherein:

the first rectifier terminal is coupled to the second capacitor terminal;

the second rectifier terminal is coupled to the second input terminal; and the at least one light-emitting diode is coupled between the first output terminal and the second output terminal.

5. The apparatus of claim 4, wherein the rectifier comprises a full-bridge rectifier.

6. The apparatus of claim 4, wherein the rectifier comprises at least one rectifying diode coupled between the first output terminal and the second output terminal with an opposite polarity to the at least one light-emitting diode.

7. The apparatus of claim 6, wherein the at least one rectifying diode comprises a light-emitting diode.

8. The apparatus of claim 1, comprising a second capacitor coupled in parallel with the at least one light-emitting diode.

9. The apparatus of claim 1, wherein the apparatus comprises a lamp assembly for housing the at least one light-emitting diode.

10. A method comprising:

receiving an input waveform at an input having a first input terminal and a second input terminal; and generating light from at least one light-emitting diode in conformity with at least one of an amplitude modulation and a frequency modulation of the input waveform, wherein the at least one light-emitting diode is coupled in series with a capacitor having a first capacitor terminal and a second capacitor terminal, such that the first capacitor terminal is coupled to the first input terminal and the at least one light-emitting diode is coupled between the second capacitor terminal and the second input terminal.

11. The apparatus of claim 10, wherein at least one of a frequency and an amplitude of the input waveform is based on a control setting of a dimmer.

12. The apparatus of claim 11, wherein the input waveform has a frequency substantially greater than a frequency of a signal received by the dimmer.

* * * * *